US007416361B1

(12) United States Patent
Ostrobrod

(10) Patent No.: US 7,416,361 B1
(45) Date of Patent: Aug. 26, 2008

(54) EXTENDABLE POLE FOR WINDOW WASHING

(76) Inventor: Meyer Ostrobrod, 2070 Bennett Rd., Philadelphia, PA (US) 19116

( * ) Notice: Subject to any disclaimer, the term of this patent is extended or adjusted under 35 U.S.C. 154(b) by 0 days.

(21) Appl. No.: 11/825,924

(22) Filed: Jul. 10, 2007

(51) Int. Cl.
*A46B 11/06* (2006.01)
*A46B 5/02* (2006.01)
*A45C 3/00* (2006.01)
*A45C 7/00* (2006.01)

(52) U.S. Cl. ..... 401/289; 16/427; 16/429; 15/144.3

(58) Field of Classification Search ..... 401/289, 401/290; 15/144.3, 144.4, 232, 320, 321, 15/322; 16/427, 429
See application file for complete search history.

(56) References Cited

U.S. PATENT DOCUMENTS 4,524,484 A 6/1985 Graham
4,856,929 A 8/1989 Smahlik et al.
5,375,938 A 12/1994 Bartlow
6,908,249 B2 6/2005 Tomm
6,925,686 B2 * 8/2005 Heathcock et al. ..... 16/429
7,008,130 B1 * 3/2006 Hill ..... 401/27
2003/0180085 A1 * 9/2003 Hughes ..... 401/289
2005/0123344 A1 6/2005 Bensussan
2006/0188320 A1 * 8/2006 Banco et al. ..... 401/139

OTHER PUBLICATIONS

Unger Window Cleaning, HiFlo Carbon Tec System, Water Fed Pole System (4 pages).

* cited by examiner

*Primary Examiner*—David Walczak
*Assistant Examiner*—Michael Barca
(74) *Attorney, Agent, or Firm*—Norman E. Lehrer

(57) ABSTRACT

An extendable pole for window washing includes a plurality of substantially hollow elongated rigid tubular sections, each of which has a lower end and an upper end and a substantially cylindrical outer side wall. The upper end of one section is mechanically connected to the lower end of a section there above to form a substantially continuous pole. Apertures are formed in the side wall of each of the tubular sections adjacent the lower ends and adjacent the upper ends. An elongated flexible tube which is slightly longer than its associated tubular section extends through the interior of the tubular section with its ends passing through the lower and upper apertures to the exterior thereof. Fluid connectors at the ends of each of the tubes connect them together so that the tubes are in fluid communications with each other.

6 Claims, 3 Drawing Sheets

EXTENDABLE POLE FOR WINDOW WASHING

BACKGROUND OF THE INVENTION

The present invention is directed toward an extendable pole for window washing and more particularly toward a plurality of elongated poles that can easily be assembled and disassembled and which not only support a brush at the top thereof but carry water or other washing solution to the brush.

Extendable poles for window washing are well known in the art and are widely used. Typically, scaffolding or a support lowered from a roof is used when cleaning windows on very tall buildings or on a building having seven or eighth floors or more. On the other hand, extendable poles are typically used for washing the windows on shorter buildings and sometimes for windows located on the lower five or six floors of taller buildings.

There are, however, several problems with using such poles. For example, in one known system, the poles typically have several telescoping sections. This makes the pole rather heavy and somewhat cumbersome to use from the ground even when the pole is collapsed or telescoped in. Also, as water and/or a cleaning solution travels through the pole, leaks may occur at the joints of the telescoping sections.

U.S. Pat. No. 4,524,484 to Graham discloses a window washing extension pole with interconnecting sections. The pole has first and second telescoping sections. However, the length of the pole may not be adjusted to a height beyond the length of the two sections. Therefore, it appears that the pole may be somewhat limited in how high it may reach. Furthermore, even when only the lower section is needed, one must support the weight of the entire device.

In another type of extendable pole known in the art, the sections may be releasably connected such as by a threaded connection, locking tabs, or the like. Cleaning fluid passes up through the center of the pole. Accordingly, the connections between the pole sections must not only mechanically connect the sections together but must also form a fluid tight connection. Again, however, similar to the telescoping pole, cleaning fluid may leak at the joints. Detecting the location of the leak may be difficult and not easily accomplished by a visual inspection of the pole.

U.S. Published Patent Application No. 2005/0123344 to Bensussan discloses quick release connections for an extensible pole used to extend the reach of a variety of tools, such as a window washing implement. This pole, however, does not appear to include a water or cleaning fluid supply located through or otherwise attached to the pole so that using the pole to wash windows at a significant height would become cumbersome.

Therefore, a need exists for an extendable pole for washing windows that is light weight, may be adjusted to any desired length, is easy to use, and allows for easy visual inspection of fluid leaks.

SUMMARY OF THE INVENTION

The present invention is designed to overcome the deficiencies of the prior art discussed above. Accordingly, it is an object of the invention to provide an extendable pole for window washing that is easier to assemble and use than prior systems.

It is a further object of the present invention to provide an extendable pole for window washing that is lighter than preexisting telescoping poles.

It is a still further object of the invention to provide an extendable pole for window washing that reduces the probability of leaks and makes it easier to detect and repair any leaks that may occur.

In accordance with the illustrative embodiments demonstrating features and advantages of the present invention, there is provided an extendable pole for window washing which includes a plurality of substantially hollow elongated rigid tubular sections. Each of the tubular sections has a lower end and an upper end and a substantially cylindrical outer side wall. The upper end of one section is mechanically connected to the lower end of a section there above to form a substantially continuous pole. Apertures are formed in the side wall of each of the tubular sections adjacent the lower ends and adjacent the upper ends. An elongated flexible tube which is slightly longer than its associated tubular section extends through the interior of the tubular section with its ends passing through the lower and upper apertures to the exterior thereof. Fluid connectors at the ends of each of the tubes connect them together so that the tubes are in fluid communications with each other.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
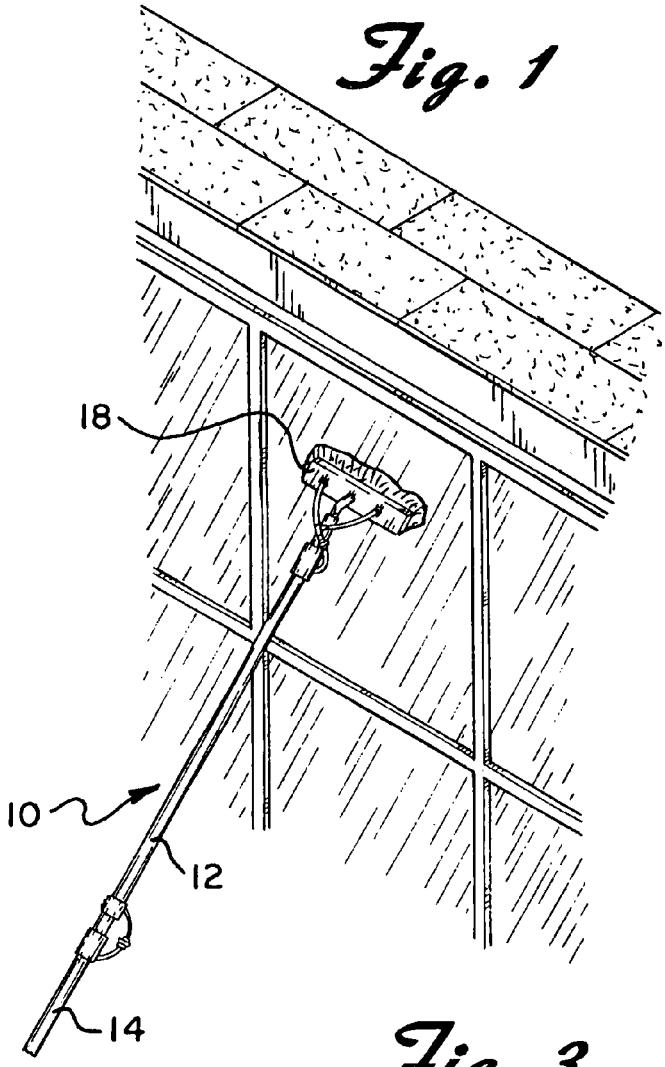
FIG. 1 is a perspective view of a portion of the window washing pole of the present invention in use washing windows.
Figure 2:
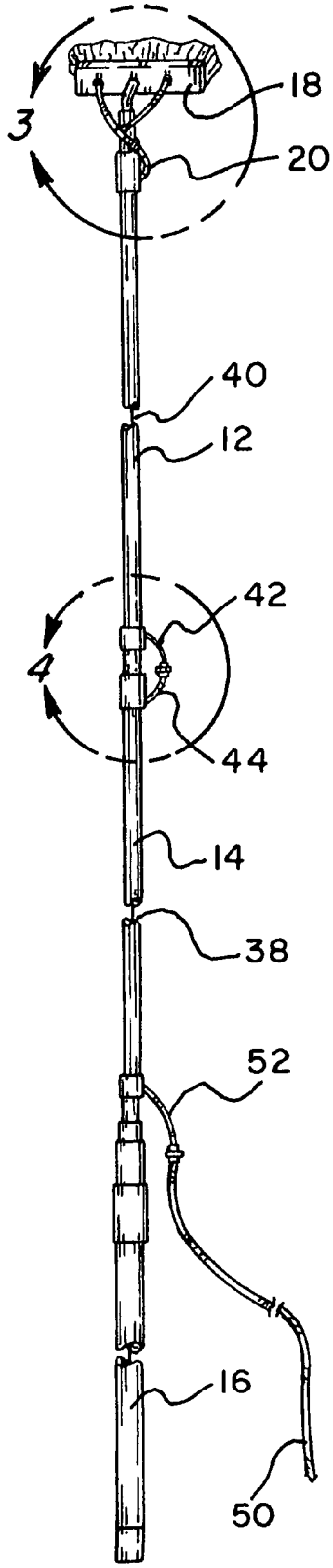
FIG. 2 is front perspective view of the window washing pole shown in FIG. 1.

Referring now to the drawings in detail wherein like reference numerals have been used throughout the various figures to designate like elements, there is shown in FIGS. 1 and 2 an extendable pole for window washing constructed in accordance with the principles of the present invention and designated generally as 10. The extendable pole 10 is comprised of a plurality of substantially hollow elongated rigid tubular sections such as shown at 12 and 14 and an elongated handle section 16. Although only two tubular sections 12 and 14 are shown, it should be readily apparent that substantially any number may be utilized as may be required. The tubular sections 12 and 14 may be between approximately 6 and 10 feet in length and are identical to each other. This allows the tubular sections to be joined together in substantially any order.

Figure 3:
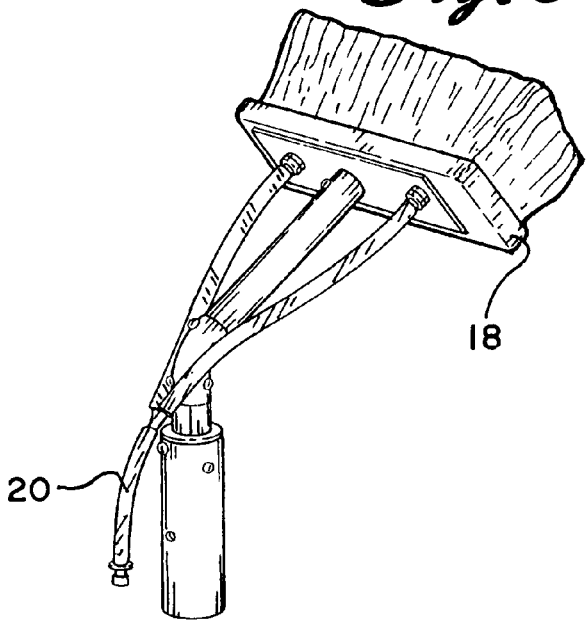
FIG. 3 is an enlarged perspective view of the brush shown at the top of the pole of FIG. 1 showing some of the details thereof.

As is known in the art, a window washing brush 18 is mounted at the top of the extendable pole. The brush 18 is, per se, well known and no description thereof is believed to be necessary. A window washing fluid and/or water is provided to the brush 18 through a flexible tube 20 as is most clearly shown in FIG. 3.

Figure 4:
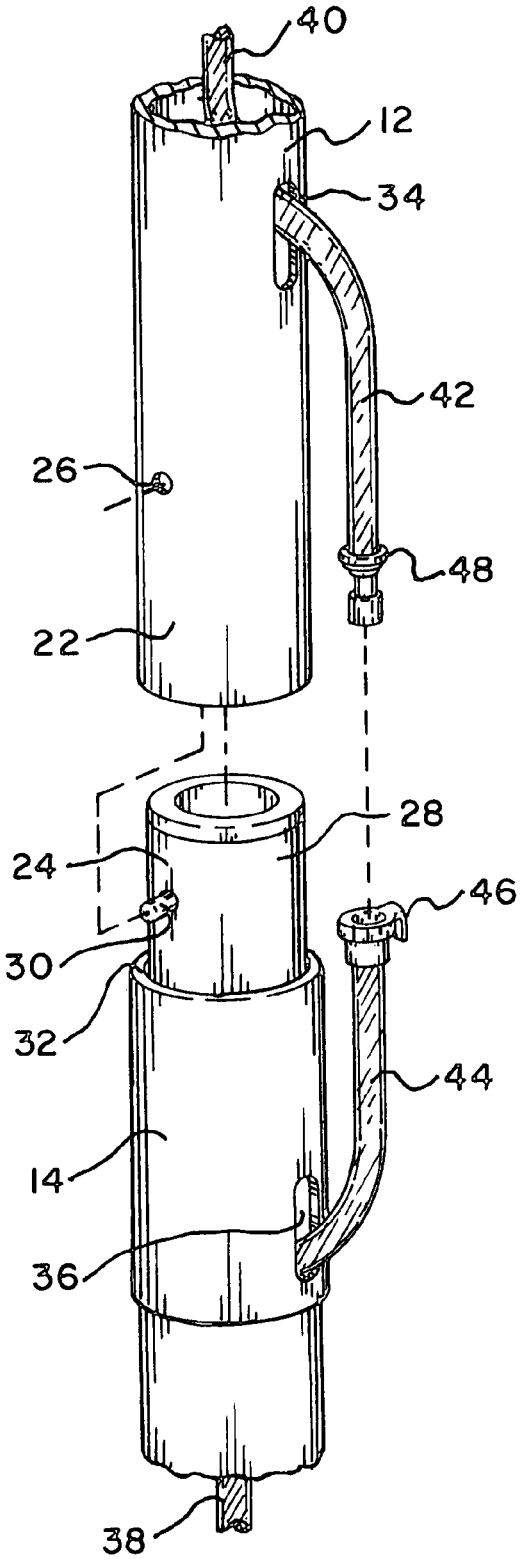
FIG. 4 is an exploded and enlarged view of the section identified by the arrows 4 in FIG. 2.
Figure 5:
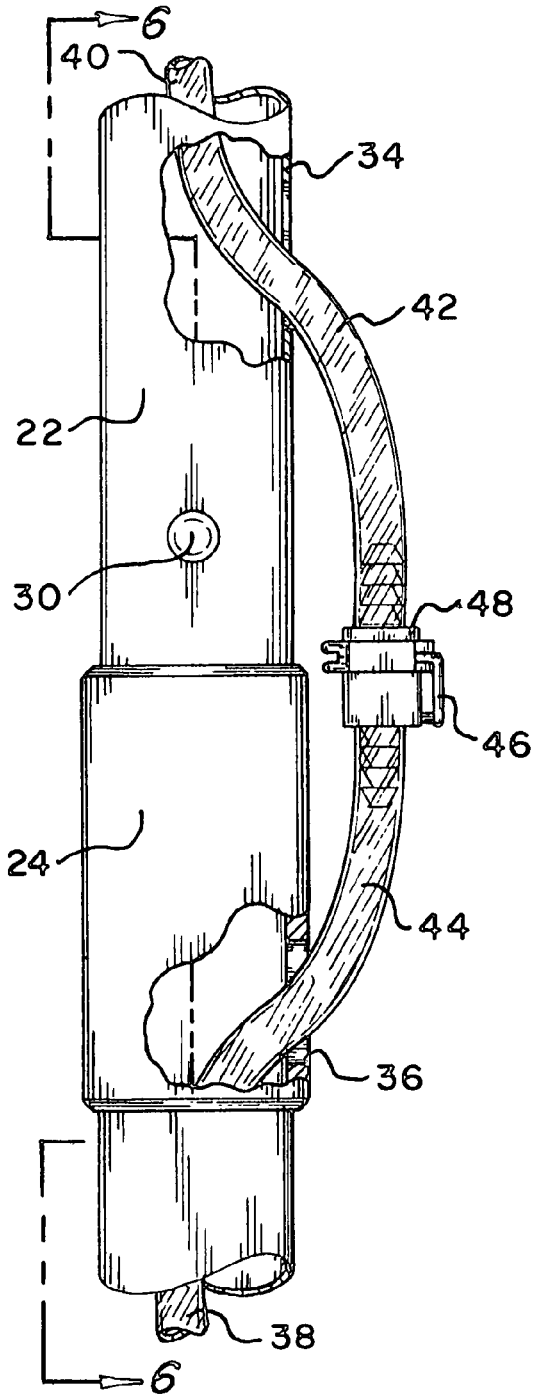
FIG. 5 is a view of the same section shown in FIG. 4 but with the parts assembled for use.

Each of the tubular sections 12 and 14 has a lower end 22 and an upper end 24. (See FIG. 4) The tubular sections are substantially cylindrical in shape and have an outer wall that extends between the upper and lower ends thereof. The tubular sections are, however, substantially hollow as can be seen in FIGS. 4, 5 and 6.

Mechanical connection means allow the lower end 22 of one tube of section to be joined to the upper end 24 of a tubular section therebelow so as to increase the length of the pole by the combined length of the sections being connected. In the preferred embodiment, the lower end 22 of the tubular section 12 is hollow and has an inner diameter which is obviously somewhat less than its outer diameter. A hole 26 is formed in the wall thereof adjacent the end. The upper end 24 of the tubular section 14, on the other hand, includes a reduced diameter portion 28 that is adapted to fit within the lower end 22 of the tubular section 12. The reduced diameter portion 28 also includes a spring-loaded pin 30 which is, per se, well known in the art.

In order to join the tubular sections 12 and 14 together, all that is necessary is to align the lower end 22 of tubular section 12 with the upper end 24 of tubular section 14 and insert the reduced diameter portion 28 of the tubular section 14 into the lower end 22 of the tubular section 12 while pressing on the pin 30. The upper end 24 of the tubular section 14 also includes a shoulder 32 which limits the axial movement of the tubular sections 12 and 14 as they are being assembled to insure that the pin 30 is in proper axial alignment with the hole 26. Thus, once the upper end 24 of the tubular section 14 is inserted into the lower end 22 of the tubular section 12, all that is needed is to rotate the two until the pin 30 extends through the hole 26.

Figure 6:
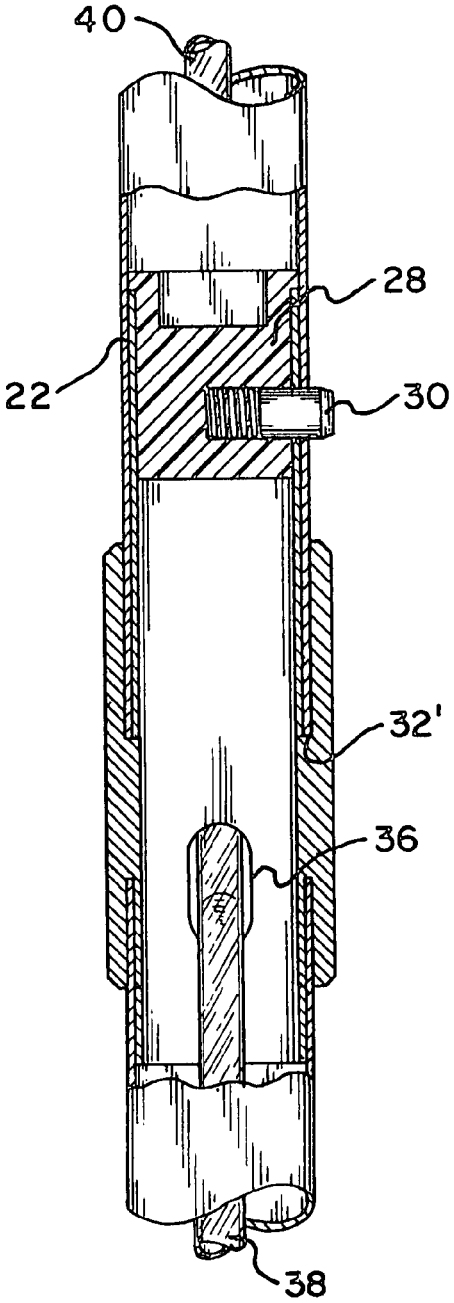
FIG. 6 is a partial cross-sectional view taken through the lines 6-6 of FIG. 5.

As shown most clearly in FIG. 6, in the preferred embodiment, the shoulder 32' that acts as a stop for the lower end 22 of the tubular section 12 can actually be axially recessed slightly. This provides a cleaner look and helps to strengthen the mechanical connection.

Each of the tubular sections 12 and 14 also has a lower aperture 34 in the side wall thereof adjacent the lower end 22 and an upper aperture 36 in the side wall adjacent the upper end 24 thereof. As most clearly shown in FIG. 4, the apertures 34 and 36 are elongated with rounded tops and bottoms. An elongated flexible tube such as shown at 38 or 40 extends through each of the tubular sections 12 and 14 with the most substantial portion of the tube lying within the interior of its associated tubular section 12 or 14. The tubes 30 and 40 are, however, slightly longer than their respective tubular sections.

Each tube 38 and 40 has a lower end 42 that passes through the lower aperture 34 to the exterior of the tubular section and an upper end 44 which passes through the upper aperture 36 to the exterior of the tubular section. Secured to the distal ends of the tubes 42 and 44 are fluid connectors 46 and 48. The fluid connectors are, per se, well known in the art and allow the tubes to be connected together in fluid communication so that water or other window washing solution fluid can pass from the very bottom of the extendable window washing pole 10 to the brush 18.

As shown most clearly in FIG. 2, fluid such as water or a cleaning solution is delivered to the tubing leading to the brush 18 by connecting the source line 50 to the end 52 of the tube extending out of the bottom of the tubular section 14. As tubular sections are added or removed, all that is necessary is to disconnect the source line 50 from the end 52 and reconnect it to the tube end (such as end 42) coming from the new lowermost tubular member.

Figure 7:
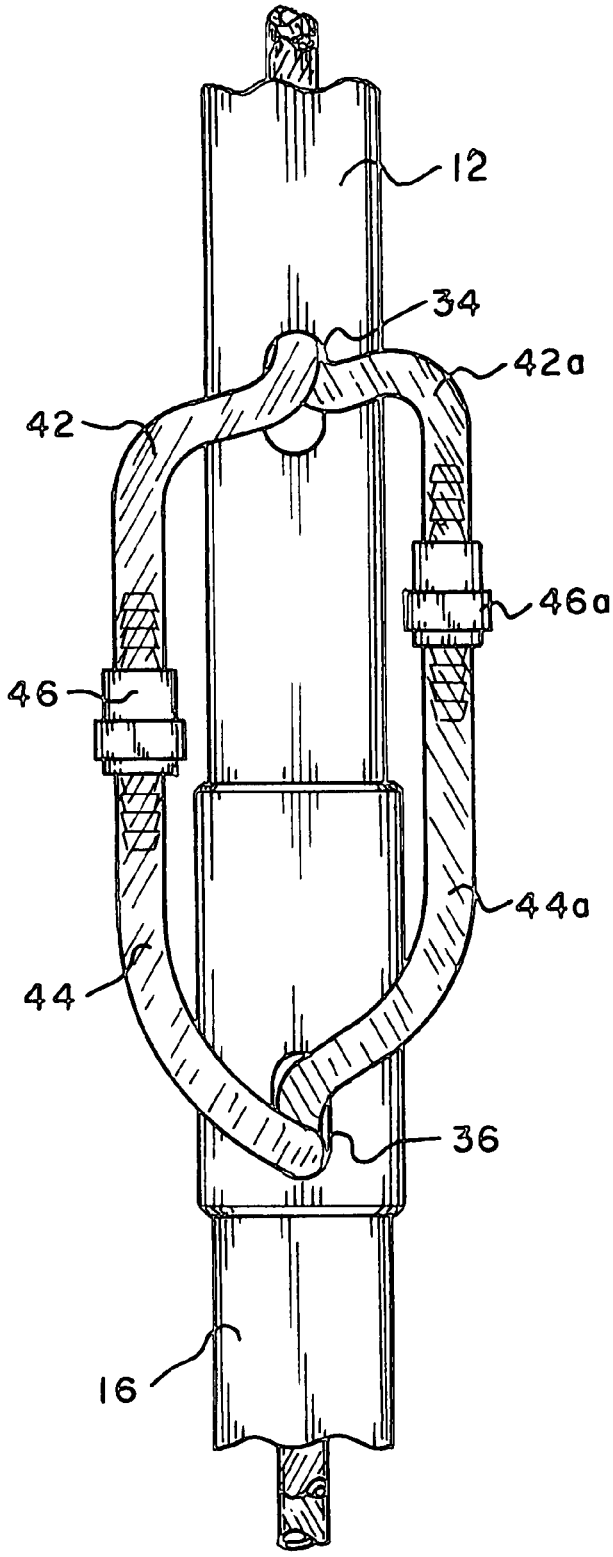
FIG. 7 is a partial view of a joint between two sections showing the use of two flexible tubes for conducting two different fluids.

In the embodiment of the invention shown in FIGS. 1-6, only one tube is used to carry fluid from a source, up the pole and to the brush 18. As shown in FIG. 7, however, it is also possible to run two (or more) separate flexible tubes. For example, the lower ends 42 and **42*a* of two tubes are shown extending through the aperture 34 while the upper ends 44 and 44*a* are shown extending through the aperture 36. The distal ends of the tubes are connected together through the use of fluid connectors 46 and 46*a*. The use of two tubes allows two separate fluids such as water and a cleaning solution to be delivered separately to the brush 18**.

Because the fluid connections are made outside of the tubular sections 12 and 14, the connectors between the two tubular sections need not make a tight fluid seal. Rather, all that is needed is a mechanical connection between the two. The fluid seal is on the outside and can be easily seen. As a result, should there be a leak, it can easily be located and either the connectors 46 and 48 can be replaced if necessary or the entire tube 38 or 40 can be easily replaced.

The present invention may be embodied in other specific forms without departing from the spirit or essential attributes thereof and accordingly, reference should be made to the appended claims rather than to the foregoing specification as indicating the scope of the invention.

I claim:

1. An extendable pole for window washing comprising:

a plurality of substantially hollow elongated rigid tubular sections, each of said tubular sections having a lower end and an upper end and a substantially cylindrical outer side wall extending between said lower and upper ends;

a first mechanical connector connected to the lower end of each of said tubular sections and a second mechanical connector connected to the upper end of each of said tubular sections, the first mechanical connector of one of said tubular members being adapted to mechanically connect to the second mechanical connector of another tubular section so as to form a pole having a length equal to the combined length of said tubular sections being connected;

a lower aperture in the side wall of each of said tubular sections adjacent the lower end thereof and an upper aperture in the side wall of each of said tubular sections adjacent the upper end thereof;

an elongated tube associated with each of said tubular sections, each tube being slightly longer than its associated tubular section and having a lower end and an upper end, a substantial portion of the length of each tube lying within the interior of its associated tubular section, the lower end of each tube passing through the lower aperture of its associated tubular section to the exterior thereof and the upper end of each tube passing through the upper aperture of its associated tubular section to the exterior thereof, and fluid connectors at the ends of each of said tubes whereby the lower end of one tube can be connected to the upper end of a different tube so that the tubes are in fluid communications with each other.

2. An extendable pole for window washing as defined in claim 1 wherein each elongated tube is flexible.

3. An extendable pole for window washing as defined in claim 1 including a plurality of tubes within each of said tubular sections.

4. An extendable pole for window washing as defined in claim 1 further including a handle section adapted to be connected to one of said tubular sections.

5. An extendable pole for window washing as defined in claim 1 further including means for connecting a cleaning utensil to one of said tubular sections.

6. An extendable pole for window washing as defined in claim 5 wherein said cleaning utensil is a brush.

* * * * *